United States Patent [19]

Hay et al.

[11] 4,282,925

[45] Aug. 11, 1981

[54] SCRAPED SURFACE HEAT EXCHANGER

[75] Inventors: Lloyd F. Hay, Oakdale; Albert F. Rica; J. R. Webber, both of Stockton, all of Calif.

[73] Assignee: FranRica Mfg. Inc., Stockton, Calif.

[21] Appl. No.: 134,266

[22] Filed: Mar. 26, 1980

[51] Int. Cl.[3] ..... F28F 5/00

[52] U.S. Cl. ..... 165/94; 165/109 R

[58] Field of Search ..... 165/94, 109 R, 109 T

[56] References Cited

U.S. PATENT DOCUMENTS

| | | | |
|---|---|---|---|
| 1,956,613 | 5/1934 | Corn et al. | 165/94 |
| 2,159,463 | 5/1939 | Voorheis | 165/94 |
| 3,054,684 | 9/1962 | Smith | 165/94 |
| 3,261,391 | 7/1966 | Gudheim | 165/94 |
| 3,955,617 | 5/1976 | Walsh | 165/94 |
| 4,048,815 | 9/1977 | Kattis | 165/94 |
| 4,126,177 | 11/1978 | Smith et al. | 165/94 |

*Primary Examiner*—Sheldon J. Richter

*Attorney, Agent, or Firm*—Wood, Herron & Evans

[57] ABSTRACT

A scraped surface heat exchanger is disclosed which includes a heat exchange cylinder and a vertically disposed rotating drum positioned within the cylinder having pivotal scraping elements on the periphery thereof for scraping the cylinder interior surface. The cylinder and drum define an annular product flow chamber through which product is pumped in heat transfer relationship to the cylinder. The heat transfer cylinder is surrounded by a thermally insulated jacket which in combination with the cylinder defines an annular flow chamber for circulation of a heat transfer medium to facilitate cooling or heating of product passing through the product flow chamber. The drum is mounted on a shaft which is journaled in a bearing at only one end, requiring utilization of only a single seal to seal the bearing from the product being heated or cooled. An indicator element integral with a carrier to which a rotating seal element is attached moves as the seal wears to provide a visual indication of seal wear. The carrier is designed such that the net product force acting on the carrier is in a direction tending to urge the relatively moving seal element together. Rotary agitating elements are provided at the inlet to the annular product flow chamber to distribute product, which is introduced at a single point, to the entirety of the inlet end of the annular product flow chamber. A mixing chamber located between the outlet end of the annular product flow chamber and the outlet of the heat exchanger is provided with cooperating stationary and rotary agitator elements to mix the product, thereby assuring uniform temperature distribution of product leaving the heat exchanger. A temperature sensor is mounted to the inner end of one of the stationary agitator elements to monitor the temperature of the material leaving the heat exchanger.

15 Claims, 6 Drawing Figures

SCRAPED SURFACE HEAT EXCHANGER

This invention relates to scraped surface heat exchangers.

Scraped surface heat exchangers, which have been used for years to heat and/or cool products, such as food and the like, typically include a heat transfer cylinder and a surrounding thermally insulated jacket between which the heating or cooling medium is circulated. Inside the heat transfer cylinder a drum rotates having pivotal scraping elements on its periphery for continuously scraping the interior surface of the cylinder. The space between the rotating drum and the heat transfer cylinder define an annular product flow chamber through which product to be heated or cooled is passed between inlet and outlet openings formed in end closures which seal the interior of the heat transfer cylinder with respect to the environment.

Typically, the rotating drum is journaled at each of its opposite ends in bearings mounted in the end closures. A seal is associated with each bearing to seal it from the product. Seals periodically wear out and must be replaced, requiring disassembly of the heat exchanger, which in turn results in down-time. Additionally, seals and their associated mounting structures are not insignificant in terms of cost. Since the prior art drum typically has two bearings, one for each end of the drum, there must be two seals, unnecessarily adding to the down-time and initial cost.

Accordingly, it has been an objective of this invention to provide a scraped surface heat exchanger in which the drum is journaled at only a single end, thereby reducing the number of seals required. This objective has been accomplished in accordance with certain of the principles of this invention by providing a scraped surface heat exchanger having a cantilevered rotary drum which includes a single bearing means, preferably mounted to a structure extending outwardly from the inlet end closure, and a single seal located inwardly of the inlet end closure. The seal surrounds a rotating drive shaft supported in the bearing which passes through a drive shaft opening in the inlet end cap or closure where it connects to the inlet end of the drum to drive it.

In accordance with a preferred embodiment of the invention, the seal includes a stationary seal ring mounted to the inlet end closure concentric to the drive shaft and a rotary seal ring located axially inboard of, and in contact with, the stationary seal ring. The rotary seal ring is mounted in a carrier which also surrounds the drive shaft. The carrier includes an extension passing axially outwardly beyond the seal rings which is axially movable and angularly immovable relative to the drive shaft. Bias means urge the carrier extension axially outwardly relative to the drive shaft, urging the rotary seal ring axially outwardly against the stationary seal ring. As the seal rings wear, the carrier moves axially outwardly. Since the carrier extension is outboard of the seal, it can be viewed and seal ring wear visually monitored.

Since product is pumped through the heat exchanger, product pressurization within the heat exchanger results. To avoid product leakage past the seal as the product pressure increases, it is necessary to increase the contact force between the rotary and stationary seal rings. In prior schemes, this typically has been accomplished by preloading the rotary and stationary seal rings, using mechanical springs or the like, to an extent sufficient to prevent leakage past the seal throughout the contemplated range of product pressure variation. The disadvantage of this approach is that a preload sufficient to prevent leakage at the maximum expected product pressure results in a contact force between the rotary and stationary seal rings which is larger than necessary to prevent seal leakage at low product pressure. As a consequence, excessive seal wear occurs under conditions of low product pressure.

In accordance with certain additional principles of this invention, the foregoing problem is obviated by configuring the carrier such that the net product force acting on it is in an axially outward direction. With such an arrangement, as the product pressure increases (decreases) the contact force between the rotary and stationary seal rings increases (decreases). For any given product pressure the force applied by the product to the carrier, and hence to the rotary seal, urging it into contact with the stationary seal, is sufficient to effect leakage-free sealing without excessive seal wear.

In accordance with certain further principles of this invention, a mixing chamber is interposed between the outlet end of the annular product flow chamber and the outlet of the heat exchanger. Plural stationary agitators extend into the mixing chamber from the mixing chamber walls to which the stationary agitator elements are mounted. Plural moving agitator elements mounted for rotary movement with the drum cooperate with the stationary agitator elements to mix, and thereby thermally homogenize, the product prior to leaving the mixing chamber. A temperature sensor is mounted to one of the stationary agitator elements, preferably at a point approximating the center of the mixing chamber, to provide accurate sensing of the temperature of product leaving the heat exchanger.

In accordance with further principles of this invention static sealing rings are provided at the interface between the inlet end of the heat exchange cylinder and the inlet end cap to inhibit leakage of product, and at the interface of the inlet end of the heat exchange cylinder and the thermal jacket to inhibit leakage of the heating and/or cooling medium. The static sealing rings are spaced apart and the space therebetween vented to the atmosphere to prevent cross-contamination between the cooling medium and product.

These and other advantages, features, and objectives of the invention will become more readily apparent from a detailed description of a preferred embodiment thereof taken in conjunction with the drawings in which.

Figure 3:
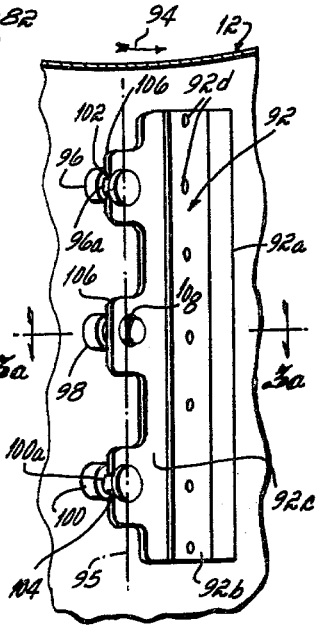
FIG. 3 is a perspective view of the scraper blade and the mounting structure for mounting it to the drum periphery.
Figure 3A:
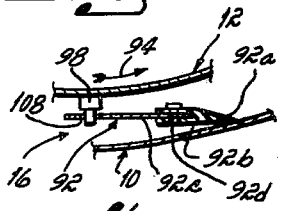
Figure 4:
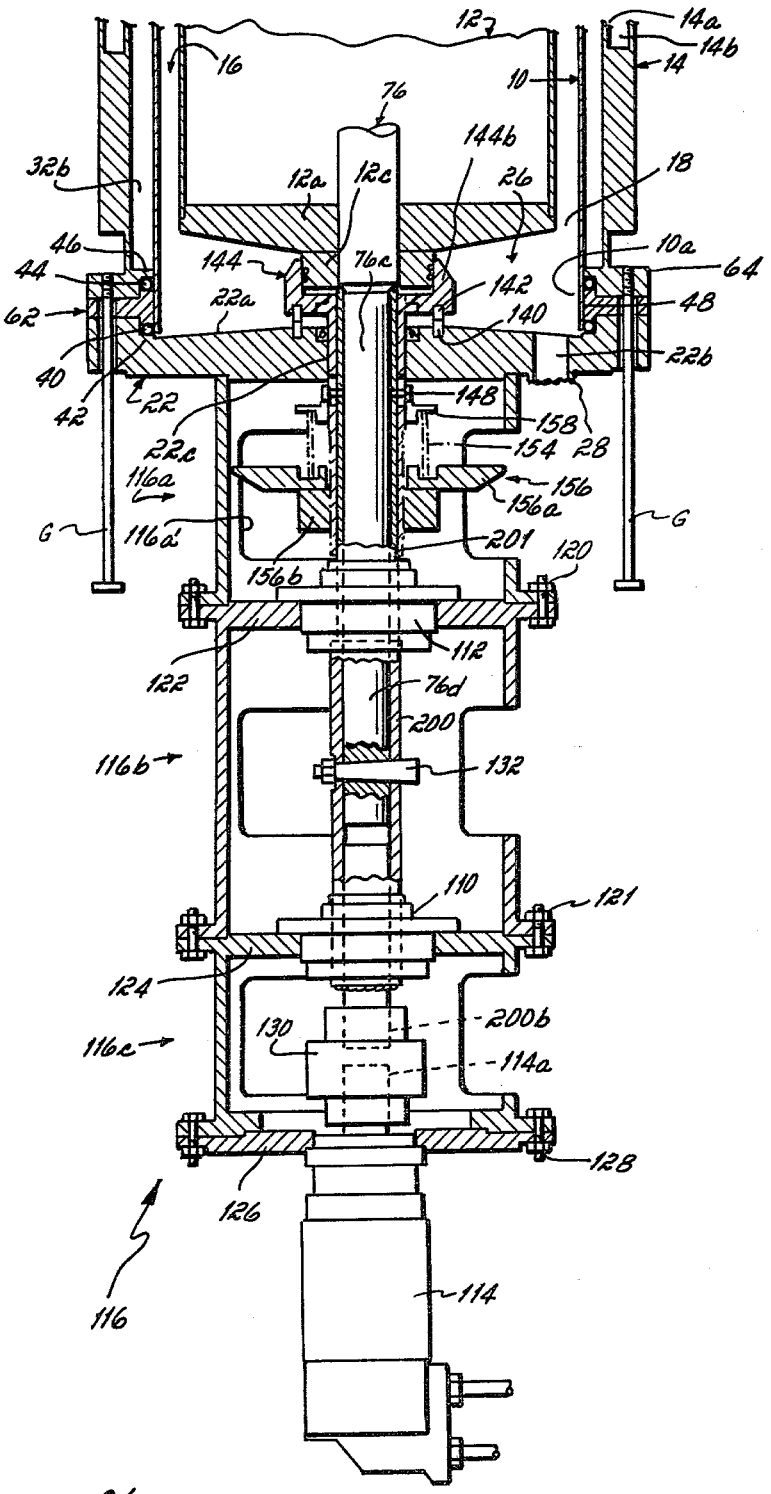
Figure 5:
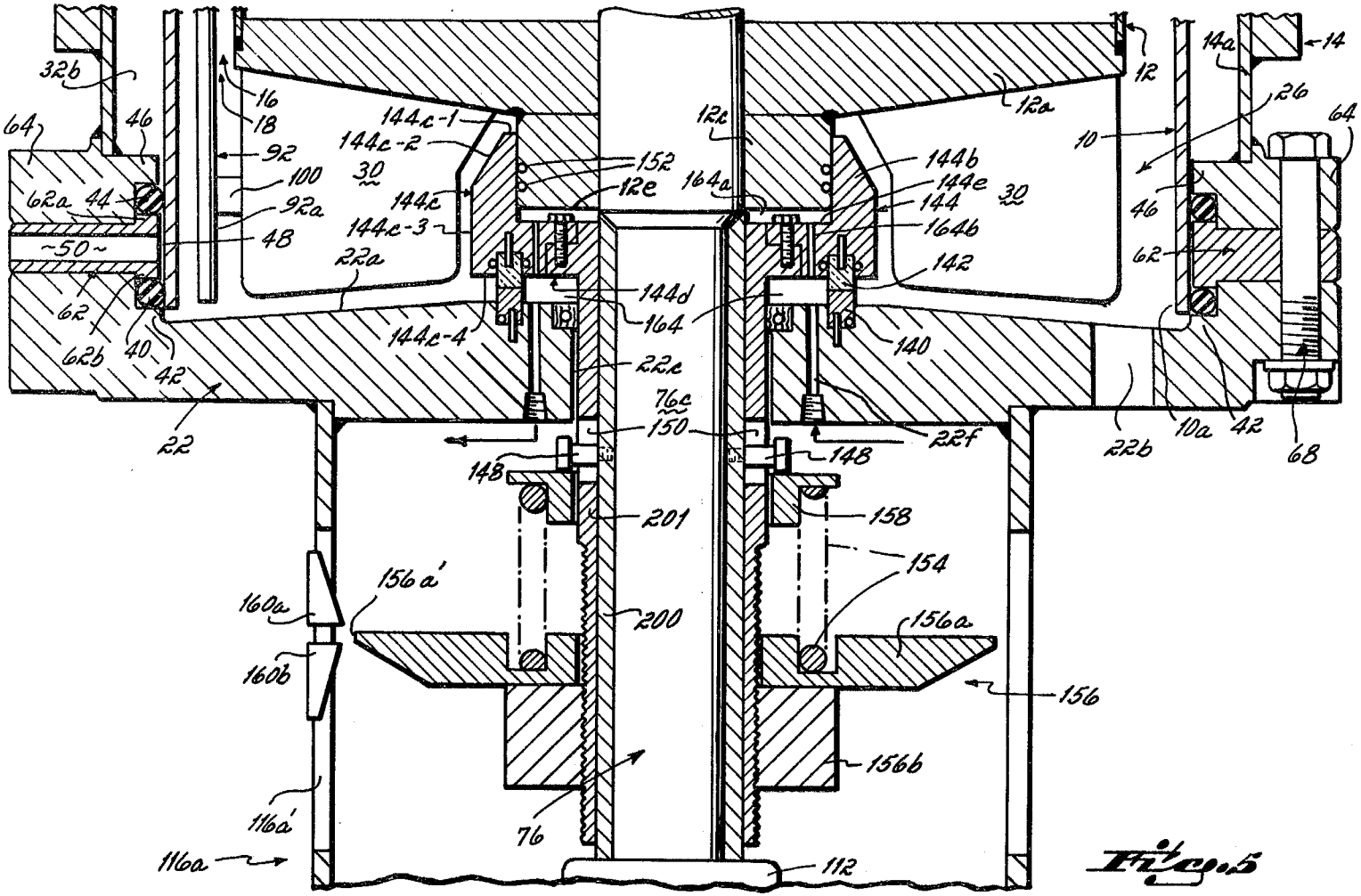

FIG. 3*a* is a cross sectional view along line 3*a*—3*a* of FIG. 3;

FIG. 4 is a front elevational view, in cross section, of the lower portion of the heat exchanger, and the drive shaft and associated bearings and bearing mount; and FIG. 5 is a front elevational view, in cross section, of the seal for the drive shaft, and the seal wear indicator and the seal preload bias assembly.

The scraped surface heat exchanger of this invention includes a heat exchanger cylinder 10 concentrically disposed, preferably vertically, between a rotary drum 12 and a thermally insulated jacket 14. The heat exchanger is supported in a vertical position by a bracket 15 secured to the exterior of the jacket 14. The bracket 15, using any suitable means (not shown), is securely anchored to the floor or other suitable support. The diameter of the drum 12, being less than that of the heat exchange cylinder 10, provides an annular product flow chamber 16 through which product, such as food, which is to be heated or cooled, is pumped from an inlet end 18 to an outlet end 20. The inlet end 10*a* of the heat exchange cylinder 10 is sealed with respect to the environment by a circular inlet end closure 22. The outlet end 10*b* of the heat exchange cylinder 10 is sealed with respect to the environment by an outlet end closure or cap structure 24.

The drum 12 is sealed at its inlet end by a circular inlet end plate 12*a* and at its outlet end by a circular outlet end plate 12*b*. Inlet end plate 12*a* is spaced from the inner surface 22*a* of the inlet end closure 22 to form an incoming product distribution chamber 26 into which product to be heated or cooled is introduced via an inlet opening 22*b* formed in the inlet end closure 22. Inlet opening 22*b* is connected via a suitable conduit or pipe 28 to a source of pressurized product (not shown), such as a product supply vessel or container and associated pump which supplies the product under pressure to the inlet distribution chamber 26.

Secured to the bottom surface of the inlet end plate 12*a* are a plurality, preferably four, vertically disposed agitator elements or paddles 30. As the drum 12 rotates about its longitudinal vertical axis, paddles 30 distribute incoming product, introduced into the inlet distribution chamber 26 via pipe 28 and opening 22*b*, to the entirety of the annular inlet end 18 of the annular product flow chamber 16. Were the paddles 30 not utilized to distribute the incoming product around the entire periphery of the inlet end of the drum 12, the entering product, which is introduced into chamber 26 via opening 22*b* at a single point, would tend to channel, or flow in a preferential manner, through the annular product flow chamber 16 primarily along a vertical path opposite the inlet opening 22*b*. However, by reason of the incoming product distributing action of the rotating paddles 30, the incoming product introduced into the inlet product distribution chamber 26 via opening 22*b* is relatively uniformly distributed throughout the entirety of the inlet end 18 of the annular product flow chamber 16, thereby avoiding nonuniform flow through the annular product flow chamber 16.

The heat exchange jacket 14 includes a cylinder 14*a* surrounded by thermal insulation 14*b*. The diameter of the jacket cylinder 14*a* is greater than that of the heat exchange cylinder 10, providing an annular chamber 32 through which heating or cooling medium flows for heating or cooling product pumped through the annular product flow chamber 16 from the inlet end 18 to the outlet end 20. The heating or cooling medium chamber 32 is divided into an upper section 32*a* and a lower section 32*b*, each having its own inlets 32*a*′ and 32*b*′ and its own outlets 32*a*″ and 32*b*″, by a pair of cooperating ribs 34 and 36 secured to the exterior of the heat exchange cylinder 10 and the interior of the jacket cylinder 14*a*, respectively. An O-ring 38 is sandwiched between the circular ribs 34 and 36 to seal the upper and lower medium flow chambers 32*a* and 32*b* from each other.

The inlet end 10*a* of the heat exchange cylinder 10 is sealed with respect to the inlet end closure 22 by an O-ring 40 located between the exterior surface of the inlet end of the heat exchange cylinder 10 and a circular inside shoulder 42 formed on the inlet end closure 22. O-ring 40 inhibits leakage of product, under pressure in the inlet product distribution chamber 26, from leaking past the interface of the inlet end 10*a* of the heat exchange cylinder 10 and the inlet end closure 22. The inlet end 10*a* of the heat exchange cylinder 10 is sealed with respect to the lower medium chamber 32*b* by an O-ring 44 located between the exterior surface of the inlet end of the heat exchange cylinder and an inside shoulder 46 formed on the inlet end of the jacket cylinder 14*a*. The O-ring 44 inhibits leakage of heating or cooling medium from the lower medium chamber 32*b* past the interface between the inlet end 10*a* of the heat exchange cylinder 10 and the lower or inlet end of the jacket cylinder 14*a*. As shown in FIG. 5, the O-rings 40 and 44 are vertically spaced with respect to each other and the space 48 therebetween is vented to atmosphere via a vent 50. As a consequence, pressurized product or medium leaking past O-rings 40 and 44, respectively, will not cross-contaminate the medium chamber 32 and product inlet distribution chamber 26, respectively, but rather will exhaust to atmosphere via vent 50.

An annular ring 62 having upper and lower internal shoulders 62*a* and 62*b* is located between the peripheral portion of the inlet end closure 22 and a flange 64 which extends radially outwardly from the lower end of the jacket 14. The shoulders 62*a* and 62*b* on ring 62 cooperate with the shoulders 42 and 46 to confine the O-rings 40 and 44.

The inlet end closure 22 and the ring 62 are secured to the flange 64 of the jacket 14 by a series of circumferentially spaced fasteners, such as bolts and nuts 68 which pass through aligned holes therein.

The outlet end closure 24 is provided with a product outlet opening 24*a* which is centrally disposed and in general axial alignment with the longitudinal axis of the drum 12. The outlet end closure 24 includes a generally cylindrical section 24*b* which defines a product mixing and hold chamber 70 located above the drum 12 between the outlet end thereof and product outlet opening 24*a*. Extending radially inwardly from the cylindrical section 24*b* are a plurality of stationary agitator elements 72 which are secured to the interior surface of the cylindrical section 24*b*. Cooperating with the stationary agitator elements 72 are a plurality of rotary agitator elements 74. The rotary agitator elements 74 extend radially from, and are mounted to, an upper extension 76*a* of a drive shaft 76 on which the drum 12 is mounted for rotation about its longitudinal axis in a manner to be described in more detail hereafter.

With respect to the drive shaft 76, at this point it is sufficient to note only that the drive shaft passes through apertures formed in inlet end plate 12*a* and outlet end plate 12*b*. Preferably, the end plates 12*a* and 12*b* of the drum are welded to the shaft 76 proximate the openings therein through which the shaft passes, thereby sealing the interior of the drum with respect to the inlet product distribution chamber 26, the annular product flow chamber 16, and the product mix and hold chamber 70.

As the shaft extension 76*a* rotates about its longitudinal axis, the radial agitator elements 74 rotate and in combination with the stationary agitator element 72 cooperate to mix in chamber 70 the heated or cooled product leaving the annular product flow chamber 10, thereby assuring uniformity in temperature of the product leaving the heat exchanger via product outlet opening 24*a*. A temperature sensor 78 located at the inner end of stationary radially disposed agitator 72, such as a thermocouple or other suitable temperature-sensing transducer, is provided to monitor the temperature of the product leaving the heat exchanger via product outlet opening 24*a*. The temperature sensor 78, by virtue of being generally centrally located within the product mix and hold chamber 70 and in general alignment with the product outlet opening 24*a*, provides a reliable and accurate indication of the temperature of the product leaving the heat exchanger. The output of the temperature sensor can be monitored externally of the heat exchanger by the provision of electrical wires (not shown) within the interior of the stationary agitator element 72 which for this purpose would be hollow.

The outlet end 10*b* of the heat exchange cylinder 10 is provided with a radially outwardly extending flange 80 which is sandwiched between similarly oriented flanges 82 and 84 extending from the outlet end of the jacket 14 and the lower end of the cylindrical section 24*b* of outlet end closure 24, respectively. A circumferential clamp 86 urges the flanges 82 and 84 toward each other, tightly clamping flanges 80, 82, and 84 together. The clamp 86 is removable to permit the outlet end closure 24 to be removed, as well as to permit the heat exchange cylinder 10 to be withdrawn from the jacket 14. An O-ring 88 is provided between the confronting surfaces of flanges 80 and 84 to seal the interface therebetween and inhibit leakage of product from the outlet end of the product chamber 20 to the environment. An O-ring 90 located between the confronting surfaces of flanges 80 and 82 is provided to seal the interface therebetween and inhibit leakage of heating or cooling medium from the upper medium chamber 32*a* to the environment. The interface between flanges 80 and 82 and the interface between flanges 80 and 84 at points radially outboard of O-rings 90 and 88, that is, at their radially outermost periphery, communicate with the environment. As a consequence, product leakage past O-ring 88 or heating or cooling medium leakage past O-ring 90 will not cross-contaminate the contents of the upper medium chamber 32*a* and the product flow chamber 16 or mix and hold chamber 70.

Figure 1:
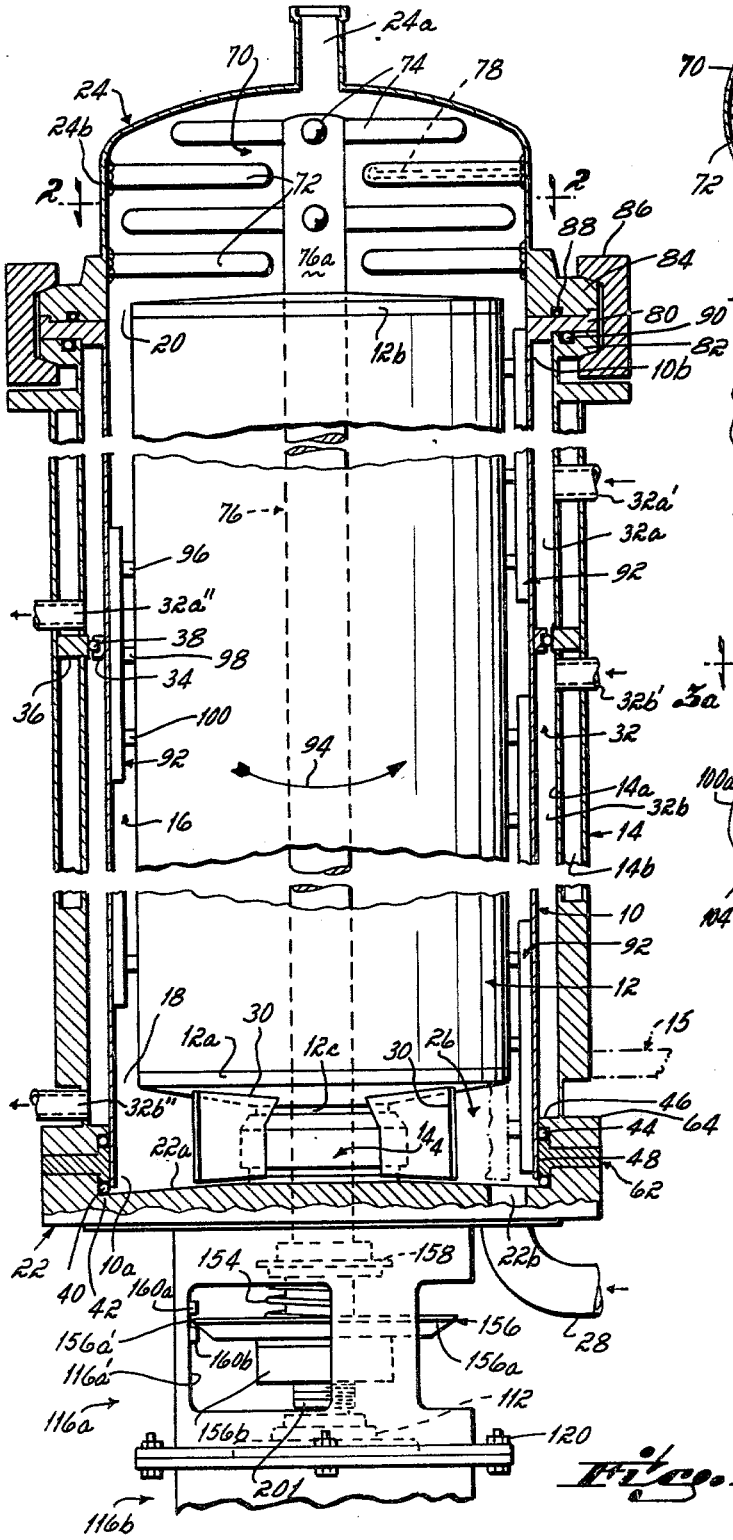
FIG. 1 is a front elevational view, in cross section, of the heat exchanger and a portion of the rotary drive shaft for the drum.
Figure 2:
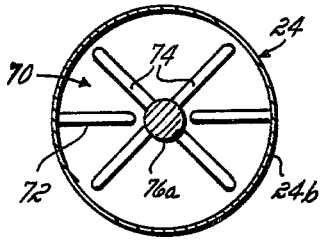
FIG. 2 is a cross sectional view along line 2—2 of FIG. 1.

A plurality of blades 92 is pivotally mounted to the exterior surface of the drum 12 to scrape accumulated product from the interior surface of the heat exchange cylinder 10 as the drum rotates in the direction of arrow 94 (FIG. 1). Blades 92 are mounted for pivotal movement about a longitudinal axis 95 disposed parallel to the drive shaft 76 by three posts 96, 98, and 100 which extend radially outward from and are secured to the surface of the drum 12. The posts 96 and 100 have circumferential grooves 96*a* and 100*a* adjacent their free ends which loosely seat in notches 102 and 104 formed in the rear edge 106 of blade 92. The post 98 has a reduced diameter free end, or shoulder, which loosely seats in an aperture 108 formed adjacent the rear edge 106 of the blade 92.

As the drum 12 rotates in the direction of arrow 94, product in the annular chamber 16 located forward (relative to its direction of rotation) of blade pivot axis 95 exerts a force on the blade tending to urge it outwardly such that its edge 92*a* wipes or scrapes accumulated product from the interior surface of the heat exchange cylinder 10. As the drum rotates, product in annular chamber 16 located rearwardly (relative to its direction of rotation) of the pivot axis 95 applies a force to blade 92 tending to pivot the blade edge 92*a* toward the drum. To minimize this latter force, the rear marginal portion 106 of the blade 92 is removed except for those areas thereof surrounding posts 96, 98, and 100. To facilitate restoration of the blade edge 92*a* to its original condition without replacement of the entire blade, the blade 92 is provided with a wear strip 92*b* which is secured to the remaining portion 92*c* of the blade by fasteners 92*d*.

In accordance with a preferred form of assembly, blade 92 is forcibly bowed such that slots 102 and 104 may engage pins 96 and 100 while hole 108 passes over pin 98. Upon relieving the bowing force, blade 92 straightens out and pin 98 impales hole 108 thereby securely anchoring blade 92 to drum 12.

The drum 12, as noted previously, is mounted on a shaft 76 and passes through aligned openings in inlet end plate 12*a* and outlet end plate 12*b*. The drive shaft 76 is welded to the inlet and outlet end plates 12*a* and 12*b* to prevent relative angular and axial motion therebetween. The drive shaft 76 also extends through an opening 22*c* in the center of the inlet end closure 22. The drive shaft 76 is journaled for rotation about a vertical axis by a pair of vertically spaced coaxial bearings 110 and 112. A motor 114, preferably of the hydraulic type, is secured to the lower end of the shaft 76 for rotating the shaft, and hence the drum 12, in the desired direction.

The bearings 110 and 112 and the motor 114 are mounted to the inlet end closure 22 via a tubular assembly 116 secured to and downwardly extending from the exterior surface of the outlet end closure 22. The tubular assembly 16 includes three cylinders 116*a*, 116*b*, and 116*c* which are fastened in end-to-end relation by suitable fasteners 120 and 121. An apertured circular disc 122 formed integral with the upper end of the cylinder 116*b* mounts the bearing 112. An apertured circular disc 124 formed integral with the upper end of cylinder 116*c* mounts the bearing 110. An apertured circular disc 126 fastened to the lower end of the cylinder 116*c* by fasteners 128 mounts the motor 114. Cylinder 116*a* is secured to the lower surface of inlet end closure 22 in any suitable manner, for example, by welding.

A coupling 130 is provided between the solid lower extension end 200*b* of a hollow shaft 200 and the output shaft 114*a* of the motor 114 to facilitate disassembly and removal of the motor from the drive shaft. The shaft portion 76*d* of the drive shaft 76*c* which passes through the opening 22*c* in the inlet end closure 22 releasably engages via pin 132 the portion of the hollow drive shaft 200 located below the bearing 112. Specifically, the drive shaft section 76*d* is normally located within a bore in drive shaft section 200 and secured against relative axial and angular movement by a pin 132 which passes transversely through aligned openings formed in the shaft sections 76*d* and 200.

To isolate and seal the interior of the inlet product distribution chamber 26 from the environment, a stationary annular seal ring 140 fixedly mounted in a suitably positioned groove in the inner surface 22*a* of the inlet closure 22 coaxial with the shaft 76 is provided in combination with a rotary seal ring 142 mounted for rotation with and coaxial to the shaft 76 and drum 12. The rotary seal 142 is mounted in a groove formed in the lower surface of a carrier 144 which surrounds the shaft 76. The carrier 144 is bolted to carrier shaft 201 which extends into the cylinder 116*a* through the opening 22*c* in the inlet end closure 22. The carrier shaft 201, and the carrier 144 and carrier-mounted rotary seal ring 142 connected therewith, are axially movable and angularly immovable relative to the shaft 200 by reason of a pair of pins 148 anchored in the hollow drive shaft 200 which extend through longitudinal slots 150 formed in the carrier shaft 201.

The upper end of the carrier 144 has an integral circular lip 144*b* which surrounds an integral cylindrical extension 12*c* formed on the lower surface of the inlet end plate 12*a* of drum 12. A pair of O-rings 152 in end plate extension 12*c* cooperate with the inner cylindrical surface of the carrier lip 144*b* to provide a static seal between the end plate extension 12*c* and the carrier lip 144*b*. The drum end plate extension 12*c* does not move angularly relative to the carrier lip 144*b*, although there is relative axial movement therebetween as the seal rings 140 and 142 wear, as will become more readily apparent hereafter. The drive shaft 76 does not move in axial direction during normal use when the heat exchanger is fully assembled, although it can move axially when the heat exchanger is disassembled and the drum removed.

To facilitate the application of a preload force between the stationary seal ring 140 and the rotary seal ring 142, bias means, preferably in the form of a compression spring 154, is provided. The compression spring 154 is located between a collar assembly 156 and a collar 158. Collar assembly 156 is adjustable axially relative to the carrier shaft 201 to adjust the preload force, but otherwise is not normally axially movable relative to the carrier shaft. Collar 158 is freely movable axially relative to the carrier shaft. The collar 158 is prevented from moving vertically upwardly relative to the drive shaft 76 by reason of pins 148. Thus, collar 158 is effectively immovable axially relative to the drive shaft 76, while the collar assembly 156 is effectively immovable axially relative to the carrier shaft 201. As a consequence of the foregoing, and by reason of the fact that the compression spring 154 urges the collars 158 and 156 apart, the carrier shaft 201 and hence the carrier 144 is urged vertically downwardly relative to the shaft 76 which itself is normally immovable in a vertical direction. As a consequence, the rotary seal 142 is urged downwardly against the stationary seal 140 with a preload force dependent upon the compression force of the spring 154.

To adjust the preload force between the seals 142 and 140 provided by the spring 154, the collar assembly 156 is formed of a collar 156*a* axially slideable relative to the carrier shaft 201 and a nut 156*b* threadable on the carrier shaft 201. By advancing or retracting the nut 156*b* relative to the carrier shaft 201, the vertical position of collar 156*a* can be varied relative to carrier shaft 201.

Since the rotary seal 142 is mounted to the carrier 144, as the seals 140 and 142 wear, the carrier 144 moves downwardly relative to shaft 76 under the action of the spring force 154 transmitted to the carrier by the carrier shaft 201 and the collar assembly 156. Downward movement of the carrier 144 results in downward movement of the carrier shaft 201 and the collar assembly 156 secured thereto. When seals 140 and 142 wear, it is possible to visually determine the extent of wear by monitoring the downward vertical movement of the carrier shaft 201. This movement can be most conveniently visually monitored by observing the position of the peripheral edge 156*a'* of collar 156*a* relative to a pair of markers 160*a* and 160*b* which are adjustably vertically positionable relative to the vertically immovable cylinder 116*a*. To facilitate viewing the position of the collar edge 156*a'* relative to the markers 160*a* and 160*b*, a window or opening 116*a'* is provided in cylinder 116. The window or opening 116*a'* also facilitates access to the nut 156*b* for adjusting the preload force on seal rings 140 and 142 provided by the compression spring 154.

In practice, the lower edge of marker 160*a* is aligned with the edge 156*a'* of collar 156*a* when new seals 140 and 142 having no wear are installed. Downward vertical movement of the collar edge 156*a'* relative to the lower edge of marker 160*a* reflects wear of the rings 140 and 142. In practice, the upper edge of marker 160*b* is adjusted to represent the position of maximum permissible wear of seal rings 140 and 142. When the edge 156*a'* of collar 156*a* is aligned with the upper edge of marker 160*b*, the seals 140 and 142 have worn to the maximum permissible extent, which is equal to the vertical distance between the lower edge of marker 160*a* and the upper edge of marker 160*b*. When maximum wear has occurred, the seals are replaced.

To remove the rotor 12 and/or replace one or both of the seals 140, 142, the clamp ring 86 is removed and the cap 24 lifted off to expose the upper end 76*a* of the rotor. With the upper end 76*a* of the rotor exposed, a hoist (not shown) is attached to the upper end of the rotor. The bolts 68 which secure the lower end closure 22 to the flange 64 of the insulated jacket 14 are now removed. At this point the rotor 12, as well as the closure 22 and the elements therebelow, are held vertically against movement relative to the jacket 14, which is stationarily mounted via bracket 15, by the hoist (not shown) which is attached to the upper end 76*a* of the rotor. The hoist is now actuated to lower the rotor 12, which in turn lowers the end closure and the various elements located therebelow. Downward movement of the rotor 12 and the end closure 22 and associated elements located therebelow continues for a distance of approximately eight inches until such time as further downward movement of the end closure 22 is prevented by guide pins G (shown only in FIG. 4). Guide pins G, which are each anchored at their upper end to flange 64, pass through oversized openings in the marginal portion of the ring 62 and end closure 22, terminating at their lower ends in enlarged heads. When closure 22 has moved downwardly to the extent permitted by guide pins G, the closure is spaced approximately eight inches below its normal position adjacent the flange 64, providing access to the seal elements 140 and 142 to facilitate removal and replacement thereof. If it is desired to remove the rotor 12, the pin 132 is removed and the rotor lifted vertically out of the heat exchange drum 10 with the hoist attached to rotor end 76*a*. Reassembly of the rotor 12 and return of the closure 22 to its normal position is accomplished by reversing the steps just described.

The rotary and stationary seals 140 and 142 divide the exposed surface of the carrier 144 into a first surface region 144*c* and a second surface region 144*d*. Surface region 144*c* of the carrier 144 is exposed to the product in the inlet product distribution chamber 26. The surface region 144*c* includes an upper horizontal annular surface 144*c*-1, a downwardly and outwardly angulated surface 144*c*-2, a vertical cylindrical surface 144*c*-3, and a lower annular surface 144*c*-4. The pressure of the product in inlet product distribution chamber 26 acting on cylindrical carrier surface 144c-3 results in the production of a zero net product force on the carrier 144 in the vertical direction. Carrier surfaces 144c-1 and 144c-2 result in vertically downward forces on the carrier due to pressurized product in inlet product distribution chamber 26, while carrier surface 144c-4 produces a vertically upward force on the carrier due to pressurized product.

The carrier surfaces 144d and 144e are exposed to a sterilant, for example, steam at atmospheric pressure, in annular sterilant chambers 164 and 164a. Chamber 164 is defined by annular surface 144d of carrier 144 and the confronting portion of the inner surface 22a of inlet end closure 22 located between the carrier shaft 201 and the rotary and stationary seals 142 and 140, the inner surface of seal rings 140 and 142, and the portion of the outer cylindrical surface of carrier shaft 201 located between surface 144d and the inner surface 22a of the inlet end closure 22. The annular chamber 164a is defined by the lower end surface 12e of drum hub 12c and the confronting upper surface 144e of the carrier 144, and the portions of the hollow shaft 200 and carrier 144 between surfaces 144e and 12c. Chambers 164 and 164a communicate via passage 164b in the carrier 144. Sterilant is introduced into chamber 164 via a passage 22f in inlet end closure 22.

The carrier 144 is designed such that the net force on the carrier 144 due to pressurized product acting on surface 144c in combination with the sterilant force acting on surface 144d is such that the carrier 144 is urged downwardly with a force dependent upon the magnitude of the pressure of the product in the inlet product distribution chamber 26. Preferably, the net downward force on the carrier 144 is proportional to approximately 20% of the pressure of the product in the inlet product distribution chamber 26. In this way, as the product pressure increases, the sealing pressure between the rotary and stationary seals 140 and 142 increases commensurately. This permits obtaining the necessary sealing force between the rings 140 and 142, as the product pressure increases, from the increase in the product pressure itself, rather than by providing it mechanically through the spring 154. The problem with obtaining the necessary sealing force between rings 140 and 142 solely from the spring 154 is that for product pressures variable over a range the spring 154 has to be adjusted such that it provides the necessary sealing force when the product pressure is at its contemplated maximum. When product pressure is less than the expected maximum, the sealing force provided by the spring is more than necessary, resulting in unnecessary wear of the sealing rings 140 and 142.

Having described the invention what is claimed is:

1. A heat exchanger comprising:

a heat exchange cylinder having an inlet end and an outlet end, a rotatable element positioned within said heat exchange cylinder and defining therewith a product flow chamber having an inlet end and an outlet end between which product flows in said product flow chamber in heat transfer relation to said heat exchange cylinder, a thermally insulated jacket surrounding said heat exchange cylinder and spaced therefrom to define a flow chamber for a medium which is in heat transfer relation to said product via said heat exchange cylinder, a drive shaft connected to said rotatable element, said drive shaft having a longitudinal axis of rotation, an inlet end closure enclosing said inlet end of said heat exchange cylinder and having a product inlet opening communicating with said inlet end of said product flow chamber, said inlet end closure having a drive shaft opening through which said drive shaft passes, an outlet end closure enclosing said outlet end of said heat exchange cylinder and having a product outlet opening communicating with said outlet end of said product flow chamber, a stationary annular seal encircling said drive shaft and mounted to said inlet end closure, a rotatable annular seal encircling said drive shaft disposed axially inwardly of said stationary seal in sealing relation therewith, a seal carrier surrounding said drive shaft and mounting said rotatable seal, said carrier being generally axially movable and angularly immovable relative to said drive shaft, means biasing said carrier axially outwardly relative to said drive shaft to urge said rotatable seal against said stationary seals and thereby preload said seal with a predetermined preload sealing force, an indicator element extending outwardly from said carrier through said drive shaft opening in said inlet end closure which moves axially with said carrier relative to said drive shaft when said seals wear to provide a visual indication of seal wear.

2. The heat exchanger of claim 1 wherein said rotatable seal divides said carrier into a first surface region configured to provide a net product force thereon in an axially outward direction and a second surface region subjected to sterilant force in an axially inward direction, the sum of said preload sealing force and said net product force exceeding said sterilant force.

3. The heat exchanger of claim 1 wherein said indicator element includes a tubular extension of said carrier surrounding said drive shaft which extends through said drive shaft opening, said tubular extension having an abutment thereon, said tubular extension and said drive shaft collectively including a slot and pin which cooperate to prevent said relative angular movement and permit said relative axial movement of said drive shaft and carrier, said biasing means including a spring surrounding said drive shaft between said pin and said abutment on said tubular extension for urging said tubular extension and said carrier axially relative to said drive shaft for preloading said rotatable and stationary seals.

4. The heat exchanger of claim 3 wherein said spring is a compression spring located between said pin and an abutment on said tubular extension located axially outwardly relative to said pin.

5. The heat exchanger of claim 4 wherein said slot is formed in said tubular extension, said pin is anchored to said drive shaft and extends radially outwardly through said slot, and said pin and abutment are detachable relative to said drive shaft and tubular extension, respectively, to facilitate disassembly of said heat exchanger.

6. The heat exchanger of claim 1 further including a bearing supporting said drive shaft, and a bearing mount extending axially outwardly from said inlet end closure for mounting said bearing axially outwardly of said seals, said drive shaft and rotatable element being unsupported by a bearing axially inwardly of said seals whereby said drive shaft and rotatable element are cantilevered to facilitate sealing said bearing from said product flow chamber with only a single seal subjected to relative rotary motion.

7. The heat exchange of claim 1 wherein said product inlet opening in said inlet end closure is radially spaced from said drive shaft, said rotatable element is a drum disposed generally concentric to said heat exchange cylinder and having inlet and outlet ends, said inlet end of said drum being closed by an inlet end plate axially spaced from said inlet end closure, said heat exchanger further including at least one product distributing element extending axially from said inlet end plate of said drum toward said inlet end closure to permit product which is introduced therebetween via said product inlet opening to be distributed substantially uniformly to the entirety of said inlet end of said product flow chamber.

8. The heat exchange of claim 7 wherein said at least one product distribusting element includes plural paddles mounted to said inlet end plate of said drum at angularly spaced locations relative to said drive shaft.

9. The heat exchange of claim 1 wherein said jacket includes an outer cylinder having inlet and outlet flanges extending radially outwardly from the opposite inlet and outlet ends thereof, said inlet and outlet end closures each having inlet and outlet flanges extending radially outwardly, and fasteners for removably securing said inlet flange of said jacket cylinder to said inlet flange of said inlet end closure and for removably securing said outlet flange of said jacket cylinder to said outlet flange of said outlet end closure, thereby facilitating insertion and removal of said heat exchange cylinder in said jacket cylinder.

10. The heat exchange of claim 9 further including a first sealing ring disposed between the exterior of said heat exchange cylinder proximate the inlet end thereof and said inlet end of said jacket cylinder to inhibit leakage of medium from said medium flow chamber at the interface of said inlet ends of said jacket cylinder and said heat exchange cylinder, a second sealing ring disposed between said inlet end of said heat exchange cylinder and said inlet end closure to inhibit leakage of product at the interface of said inlet end of said heat exchange cylinder and inlet end closure, said second sealing ring being spaced from said first sealing ring, and means venting the space between said first and second sealing rings to minimize the possibility of cross-contamination of said medium and product.

11. The heat exchange of claim 9 wherein said outlet end of said heat exchange cylinder includes a radial flange disposed between said outlet flanges of said outlet end closure and said jacket cylinder, said heat exchanger further including first and second sealing rings disposed on opposite sides of said radial flange to separately seal the interface of said radial flange and said outlet flange of said outlet end closure and the interface of said radial flange and said outlet flange of said jacket cylinder, and wherein said interfaces are exposed to the environment to minimize cross-contamination between said product and medium.

12. The heat exchange of claim 1 wherein said rotatable element is a drum having closed ends, said product flow chamber is annular, and said outlet end closure includes a generally cylindrical section axially juxtaposed with said heat exchange cylinder and drum, said cylindrical section defining a mixing chamber communicating at opposite ends thereof with said annular product flow chamber and said product outlet opening of said outlet end closure, said heat exchanger further including plural stationary agitator elements extending into said mixing chamber from said outlet end closure to which said stationary agitator elements are mounted, and plural rotary agitator elements extending into said mixing chamber and mounted for rotary movement with said drum, said rotary and stationary agitator elements cooperating to mix product output from said product flow chamber prior to leaving said heat exchanger via said product outlet opening in said outlet end closure, whereby product is mixed in said mixing chamber for a predetermined period of time dependent on the volume of said mixing chamber and the volumetric product flow rate therethrough.

13. The heat exchange of claim 12 wherein said stationary agitator elements extend generally radially into said mixing chamber from said cylindrical section to which said stationary agitator elements are mounted, and wherein said rotary agitator elements are disposed generally radially in said mixing chamber.

14. The heat exchange of claim 12 wherein one of said stationary agitator elements has an inner region disposed in the approximate center of said mixing chamber, said heat exchanger further including a temperature sensor mounted to said inner region to monitor the temperature of said mixed product leaving said mixing chamber via said product outlet opening in said outlet end closure.

15. The heat exchange of claim 14 wherein said product outlet opening is centrally disposed in said outlet end closure in alignment with the axis of rotation of said drum.

* * * * *

UNITED STATES PATENT AND TRADEMARK OFFICE

CERTIFICATE OF CORRECTION

PATENT NO. : 4,282,925

DATED : August 11, 1981

INVENTOR(S) : Lloyd F. Hay, J. R. Webber, and Albert F. Rica

It is certified that error appears in the above-identified patent and that said Letters Patent are hereby corrected as shown below:

| | | | | |
|---|---|---|---|---|
| Column 3, | line 2, | "exchanger" | should be | -- exchange --. |
| Column 10, | line 24, | "seals" | should be | -- seal --. |
| Column 10, | line 24, | "seal" | should be | -- seals --. |
| Column 11, | line 3, | "exchange" | should be | -- exchanger --. |
| Column 11, | line 16, | "exchange" | should be | -- exchanger --. |
| Column 11, | line 20, | "exchange" | should be | -- exchanger --. |
| Column 11, | line 32, | "exchange" | should be | -- exchanger --. |
| Column 11, | line 48, | "exchange" | should be | -- exchanger --. |
| Column 12, | line 8, | "exchange" | should be | -- exchanger --. |
| Column 12, | line 33, | "exchange" | should be | -- exchanger --. |
| Column 12, | line 40, | "exchange" | should be | -- exchanger --. |
| Column 12, | line 48, | "exchange" | should be | -- exchanger --. |

Signed and Sealed this

*Fourth* Day of *May 1982*

[SEAL]

*Attest:*

GERALD J. MOSSINGHOFF

*Attesting Officer*

*Commissioner of Patents and Trademarks*